US005481954A

United States Patent [19]

Parsons

[11] Patent Number: 5,481,954

[45] Date of Patent: Jan. 9, 1996

[54] BACK PLATE MOUNTED SHOULDER STRAP CONTROL FOR ELECTRIC TYPE STRINGED INSTRUMENTS

[76] Inventor: Gene V. Parsons, 44201 Caspar Orchard Rd., Caspar, Calif. 95420

[21] Appl. No.: 350,729

[22] Filed: Dec. 6, 1994

[51] Int. Cl.[6] ..... G10D 3/00

[52] U.S. Cl. ..... 84/291

[58] Field of Search ..... 84/267, 291, 327

[56] References Cited

U.S. PATENT DOCUMENTS 3,512,443 10/1968 Parson et al. ..... 84/313

4,715,259 12/1987 Wittman ..... 84/327

*Primary Examiner*—Patrick J. Stanzione

*Attorney, Agent, or Firm*—Larry D. Johnson

[57] ABSTRACT

A string pitch control apparatus for electric-type stringed instruments such as electric guitars includes a cover plate having a shoulder strap aperture to be secured to the guitar body back side to cover a routed cavity. A strap lever is pivotally mounted to the cover plate, and has a first arm attached to the guitar shoulder strap, and a second arm connected to a connecting rod and mandrel linkage. A string pulling mandrel member is pivotally mounted to the cover plate, and has a first end connected to the mandrel linkage, and a second end pivotally opposite the first end connected to a guitar string extending through the guitar body through aperture. Tension on the shoulder strap causes tension on that string, thereby increasing the pitch of that string above its tuned pitch.

3 Claims, 1 Drawing Sheet

BACK PLATE MOUNTED SHOULDER STRAP CONTROL FOR ELECTRIC TYPE STRINGED INSTRUMENTS

BACKGROUND OF THE INVENTION

1. Field of the Invention

This invention relates generally to musical instruments, and more specifically to an improved string pitch control apparatus for electric-type stringed instruments such as electric guitars.

2. Description of the Prior Art

A string pitch control for guitars and other stringed instruments is taught by Parsons et al. U.S. Pat. No. 3,512,443 entitled SHOULDER STRAP CONTROL FOR STRING INSTRUMENTS, now well known as a "string bender" pitch control device. That patent discloses an apparatus having a lever connected to the shoulder strap of a guitar and to one of the strings of the guitar, so that tension on the shoulder strap causes tension on that string, thereby changing (i.e., increasing) the pitch of that string above its tuned pitch. That former apparatus, while still functional and suitable for use in many applications, has some limitations. For example, with the structure disclosed in that patent, many holes and slots have to be made in the guitar body to which the device is being installed, and the apparatus components have to be glued into place and aligned individually with each installation.

SUMMARY OF THE INVENTION

The back plate mounted shoulder strap control for electric-type stringed instruments of this invention provides an improved string pitch control apparatus for electric-type stringed instruments such as electric guitars. The operative components of the inventive apparatus include a cover plate to be secured to the guitar body back side to cover a routed cavity, and which bears a shoulder strap aperture and a tuner wheel aperture. A strap lever is pivotally mounted to the cover plate by a strap lever pivot which defines a pivot axis. The strap lever has a first arm attached to the guitar shoulder strap, as by a peg and fastener, and a second arm connected to a connecting rod. The connecting rod connects the strap lever to a mandrel linkage. A string pulling mandrel member is pivotally mounted on a mandrel support connected to the cover plate. The mandrel member has a first end connected to the mandrel linkage, and a second end pivotally opposite the first end connected to a guitar string (e.g., the "B" string") extending through the guitar body through aperture. A bias spring has a first end connected to the strap lever second end, and a second end connected to an anchor point on the cover plate. Finally, a tuner wheel is mounted to the cover plate so that it is accessible through the tuner wheel aperture in the cover plate, and has a shaft adapted for adjustable extension against a stop element on the strap lever first arm.

This structure thus provides a lever connected to the shoulder strap of a guitar and to one of the strings of the guitar, so that tension on the shoulder strap causes tension on that string, thereby changing (i.e., increasing) the pitch of that string above its tuned pitch. In use, the shoulder strap is adjusted in length to suit the user and is placed over the shoulder and back of the user to support the guitar in the usual manner. By selective pressure upon the guitar and against the shoulder strap, the user exerts a pull on the strap lever first end, which pivots the second end to move the connecting rod, which moves the mandrel linkage to pivot the mandrel and pull the guitar string. The bias spring acts to urge the strap lever back to its normal position, while the tuner wheel can be adjusted to define a desired stop point in the pivotal travel of the strap lever.

The inventive apparatus is of unitized construction. A corresponding major advantage in the present invention is that the entire apparatus is attached to the large cover plate that is installed over the opening provided in the back of the guitar body to accommodate the apparatus. Using this design makes possible the simplification of the manufacturing process, and since the apparatus is assembled as a unit, the installation into a guitar is greatly simplified.

With the present apparatus, the openings (slots and holes) for the shoulder strap lever and tuning wheel are all in the back cover plate. A simple, easy to align routed cavity can then be made in the back of the guitar body to accept the installation of the apparatus with a few affixing screws.

With the new design the entire apparatus can be assembled as a unit ready for quick installation. The new improved design lends itself to manufacturing with punched press and resistance welding-type processes rather than machining, thus making the manufacture of the inventive apparatus much cheaper and faster.

Figure 1:
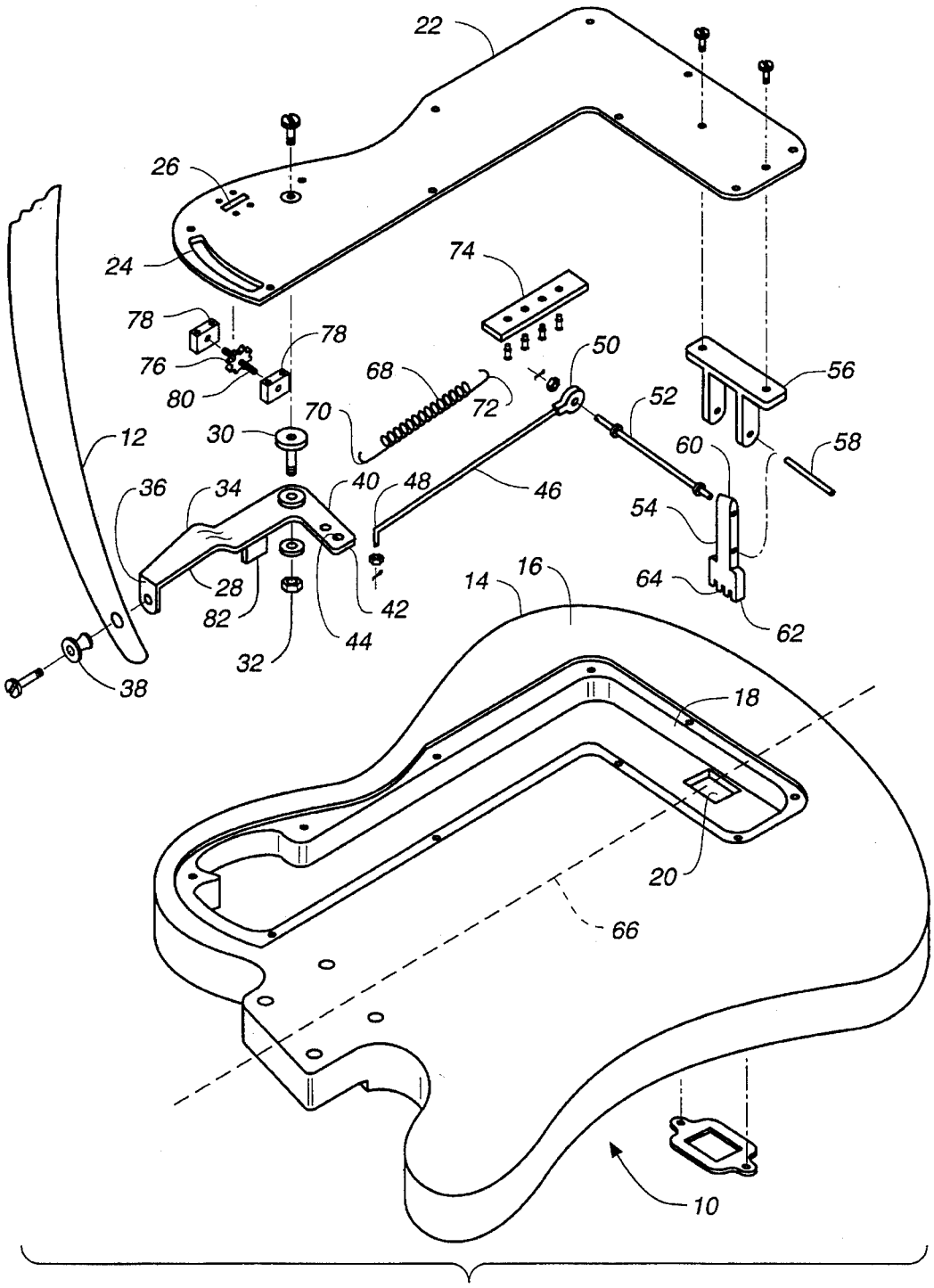
FIG. 1 is an exploded perspective view of a back plate mounted shoulder strap control for electric-type stringed instruments of this invention being installed into an electric guitar having a shoulder strap and including a guitar body having a back side bearing a routed cavity and a through aperture, this view illustrating the operative components of the inventive apparatus including.

- a cover plate portion adapted to be secured to the guitar body back side to generally cover the routed cavity, the cover plate bearing a shoulder strap aperture and a tuner wheel aperture;
- a strap lever member pivotally mounted to the cover plate portion by a strap lever pivot and defining a strap lever pivot axis, the strap lever having a first arm terminating in a first end bearing fastening means for attachment to the guitar shoulder strap, as by a peg and fastener, and a second arm terminating in a second end bearing means for connection to a connecting rod;
- a connecting rod having a first end adapted for connection to the strap lever second end, and a second end adapted for connection to a mandrel linkage;
- a string pulling mandrel member pivotally supported on a mandrel support by a fulcrum pin, the mandrel support connected to the cover plate, the mandrel member having a first end adapted for connection to the mandrel linkage, and a second end pivotally opposite the first end and carrying a string connector for attachment to a guitar string extending through the guitar body through aperture;
- a bias spring having a first end adapted for connection to the strap lever second arm, and a second end adapted for connection to an anchor point connected to the cover plate; and
- a tuner wheel mounted to the cover plate portion by a pair of mounts so that the wheel is accessible through the tuner wheel aperture in the cover plate, and having a shaft adapted for adjustable extension against a stop element on the strap lever first arm.

DETAILED DESCRIPTION OF A PREFERRED EMBODIMENT

FIG. 1 is an exploded perspective view of a back plate mounted shoulder strap control for electric-type stringed instruments of this invention being installed into an electric guitar 10 having a shoulder strap 12 and including a guitar body 14 having a back side 16 bearing a routed cavity 18 and a through aperture 20. This view illustrates the operative components of the inventive apparatus including:

a cover plate portion 22 adapted to be secured to the guitar body back side 16 to generally cover the routed cavity 18, the cover plate bearing a shoulder strap aperture 24 and a tuner wheel aperture 26;

a strap lever member 28 pivotally mounted to the cover plate portion 22 by a strap lever pivot 30 and defining a strap lever pivot axis 32, the strap lever having a first arm 34 terminating in a first end 36 bearing fastening means for attachment to the guitar shoulder strap 12, such as by a peg and fastener 38, and a second arm 40 terminating in a second end 42 bearing means (such as a hole 44) for connection to a connecting rod;

a connecting rod 46 having a first end 48 adapted for connection to the connection means 44 on strap lever second end 42, and a second end 50 adapted for connection to a mandrel linkage 52;

a string pulling mandrel member 54 pivotally supported on a mandrel support 56 by a fulcrum pin 58, the mandrel support connected to the cover plate 22, the mandrel member 54 having a first end 60 adapted for connection to the mandrel linkage 52, and a second end 62 pivotally opposite the first end 60 and carrying a string connector 64 for attachment to a guitar string 66 extending through the guitar body through aperture 20;

a bias spring 68 having a first end 70 adapted for connection to the strap lever second arm 40, and a second end 72 adapted for connection to an anchor point 74 connected to the cover plate 22; and a tuner thumb wheel 76 mounted to the cover plate portion 22 by a pair of mounts 78 so that the wheel is accessible through the tuner wheel aperture 26 in the cover plate, and having a shaft 80 adapted for adjustable extension against a stop element 82 located on the strap lever first arm 34.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A back plate mounted shoulder strap control apparatus for an electric guitar having a shoulder strap and a guitar body having a back side bearing a routed cavity and a through aperture, the apparatus comprising:

a cover plate portion adapted to be secured to said guitar body back side to generally cover said routed cavity, said cover plate including a shoulder strap aperture;

a strap lever member pivotally mounted to said cover plate portion, said strap lever having a first arm terminating in a first end including fastening means for attachment to said guitar shoulder strap, and a second arm terminating in a second end;

a connecting rod having a first end connected to said strap lever second arm, and a second end connected to a mandrel linkage;

a string pulling mandrel member pivotally supported on a mandrel support by a fulcrum pin, said mandrel support connected to said cover plate, said mandrel member having a first end connected to said mandrel linkage, and a second end carrying a string connector for attachment to a guitar string extending through the guitar body through aperture.

2. The apparatus of claim 1 further including a bias spring having a first end connected to said strap lever second arm, and a second end connected to an anchor point on said cover plate.

3. The apparatus of claim 1 further including a tuner wheel mounted to said cover plate portion, said tuner wheel having a shaft adapted for adjustable extension against a stop element on said strap lever first arm.

* * * * *